US011176894B2

(12) United States Patent
Lee et al.

(10) Patent No.: US 11,176,894 B2
(45) Date of Patent: Nov. 16, 2021

(54) DISPLAY PANEL AND DISPLAY DEVICE FOR ADJUSTING COLOR TEMPERATURE

(71) Applicant: SAMSUNG ELECTRONICS CO., LTD., Suwon-si (KR)

(72) Inventors: Kyehoon Lee, Suwon-si (KR); Dongyoon Kim, Suwon-si (KR); Beomkyun Rha, Suwon-si (KR); Mingu Roh, Suwon-si (KR); Sanghoon Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/861,953

(22) Filed: Apr. 29, 2020

(65) Prior Publication Data

US 2020/0342822 A1 Oct. 29, 2020

(30) Foreign Application Priority Data

Apr. 29, 2019 (KR) ..... 10-2019-0049813

(51) Int. Cl.
*G09G 3/34* (2006.01)
*G09G 3/36* (2006.01)

(52) U.S. Cl.
CPC ..... *G09G 3/3413* (2013.01); *G09G 3/3607* (2013.01); *G09G 2320/0666* (2013.01)

(58) Field of Classification Search
CPC ..... G09G 3/3413; G09G 3/3607; G09G 2320/0666
See application file for complete search history.

(56) References Cited

U.S. PATENT DOCUMENTS

2015/0316708 A1* 11/2015 Birman ..... G02B 6/0051 362/607
2016/0062023 A1* 3/2016 Itoh ..... G02B 6/0026 362/608
2016/0091758 A1 3/2016 Yoneyama
2018/0045395 A1* 2/2018 Kamada ..... F21S 2/00

FOREIGN PATENT DOCUMENTS

JP 2016-072521 A 5/2016
JP 2017-16785 A 1/2017
KR 20-0264847 Y1 4/2002

(Continued)

OTHER PUBLICATIONS

International Search Report dated Aug. 14, 2020 issued by the International Searching Authority in counterpart International Application No. PCT/KR2020/005582 (PCT/ISA/210).

(Continued)

*Primary Examiner* — Kenneth B Lee, Jr.
(74) *Attorney, Agent, or Firm* — Sughrue Mion, PLLC

(57) ABSTRACT

A display panel includes a first light source, a second light source having a color different from a color of the first light source, a light guide plate converting a point light source generated by the first light source and the second light source into a surface light source, a diffuser plate positioned on an upper portion of the light guide plate and diffusing the surface light source emitted by the light guide plate, and a frame supporting the light guide plate and the diffuser plate and including a protrusion protruded between the diffuser plate and the light guide plate.

17 Claims, 10 Drawing Sheets

(56) References Cited

FOREIGN PATENT DOCUMENTS

| | | | | |
|---|---|---|---|---|
| KR | 10-2011-0085126 | A | | 7/2011 |
| KR | 20110085126 | A | * | 7/2011 |
| KR | 10-2016-0015831 | A | | 2/2016 |
| KR | 10-2018-0063608 | A | | 6/2018 |
| KR | 10-1885929 | B1 | | 8/2018 |

OTHER PUBLICATIONS

International Written Opinion dated Aug. 14, 2020 issued by the International Searching Authority in counterpart International Application No. PCT/KR2020/005582 (PCT/ISA/237).

* cited by examiner

FIG. 7

| CATEGORY | CONVENTIONAL EDGE-LIT TYPE QD DISPLAY PANEL | EDGE-LIT TYPE QD DISPLAY PANEL USING FIRST AND SECOND LIGHT SOURCES |
|---|---|---|
| GRADATION EXPRESSION (Worst case) | 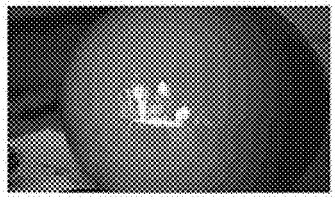 | 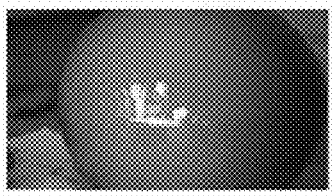 |
| BRIGHTNESS/BLACK/CONTRAST RATIO AT 6500K PANEL COLOR TEMPERATURE (CIEx 0.313 / CIEx 0.329) | BRIGHTNESS : 440nit<br>BLACK : 0.083nit<br>CONTRAST RATIO : 5300:1 | BRIGHTNESS : 520nit<br>BLACK : 0.087nit<br>CONTRAST RATIO : 6000:1 |
| BRIGHTNESS/BLACK/CONTRAST RATIO AT 10000K PANEL COLOR TEMPERATURE (CIEx 0.281 / CIEx 0.288) | BRIGHTNESS : 500nit<br>BLACK : 0.083nit<br>CONTRAST RATIO : 6000:1 | BRIGHTNESS : 500nit<br>BLACK : 0.083nit<br>CONTRAST RATIO : 6000:1 |
| BRIGHTNESS/BLACK/CONTRAST RATIO AT 14000K PANEL COLOR TEMPERATURE (CIEx 0.266 / CIEx 0.270) | BRIGHTNESS : 433nit<br>BLACK : 0.083nit<br>CONTRAST RATIO : 5210:1 | BRIGHTNESS : 472nit<br>BLACK : 0.078nit<br>CONTRAST RATIO : 6000:1 |

DISPLAY PANEL AND DISPLAY DEVICE FOR ADJUSTING COLOR TEMPERATURE

CROSS-REFERENCE TO RELATED APPLICATION(S)

This application is based on and claims priority under 35 U.S.C. § 119 to Korean Patent Application No. 10-2019-0049813, filed on Apr. 29, 2019, in the Korean Intellectual Property Office, the disclosure of which is incorporated by reference herein in its entirety.

BACKGROUND

1. Field

The disclosure relates to a display panel and a display device, more particularly, relates to a display panel and a display device for adjusting a color temperature.

2. Description of Related Art

A display device displaying an image is a device displaying an image using a display panel and is used in various devices such as a television, a computer monitor, or a smart phone. The general display device does not emit light itself, thereby it is necessary to provide a separate backlight unit including a light source, and such a backlight unit is disposed on a rear side of a liquid crystal display (LCD) of the display panel.

The backlight unit is a dimmer that evenly emits light over the entire display panel and a white LED was used as a light source of the display panel including the general backlight unit.

Recently, the backlight unit may include a film containing a quantum dot substance for improving color reproducibility on the display panel. In the display panel formed of such a quantum dot film, a blue LED was used as a light source.

Accordingly, in the related art display panel, only one type of the LED light source of the white LED or the blue LED was used as the light source, and in a case where only one type of the LED light source is used, a loss of a gray level of at least one color of blue, green, and red which are primary colors of the display was caused in order to adjust a color temperature of the display panel. The color temperature is a temperature of a black body when a wavelength of light from a light source is identical to a wavelength of light generated when heating the black body, and the unit thereof is K (Kelvin). There was a problem that, a decrease in gray level of the primary color in order to adjust the color temperature of the display panel causes a decrease in color expression level of the display panel, a loss of brightness, and a loss of a contrast ratio.

SUMMARY

According to embodiments, there is provided a display panel including at least two light sources having different colors and adjusting a color temperature by adjusting brightness of each light source and a display device including the same, in order not to decrease a maximum gray level of a primary color when adjusting the color temperature of the display panel.

In accordance with an aspect of the disclosure, there is provided a display panel including a first light source, a second light source having a color different from that of the first light source, a light guide plate converting a point light source generated by the first light source and the second light source into a surface light source, a diffuser plate positioned on an upper portion of the light guide plate and diffusing the surface light source emitted by the light guide plate, and a frame supporting the light guide plate and the diffuser plate and including a protrusion protruded between the diffuser plate and the light guide plate.

In accordance with an aspect of the disclosure, there is provided a display device including: a display panel; and a processor configured to control the display panel, in which the display panel includes a first light source, a second light source having a color different from that of the first light source, a light guide plate converting a point light source generated by the first light source and the second light source into a surface light source, a diffuser plate positioned on an upper portion of the light guide plate and diffusing the surface light source emitted by the light guide plate, and a frame supporting the light guide plate and the diffuser plate and including a protrusion protruded between the diffuser plate and the light guide plate, and the processor is further configured to adjust a color temperature of the display panel by controlling currents of the first light source and the second light source.

BRIEF DESCRIPTION OF THE DRAWINGS

The above-discussed concepts and other aspects, features, and advantages of certain embodiments of the present disclosure will be more apparent from the following description taken in conjunction with the accompanying drawings, in which:

FIG. 7 is a view for comparing a related art quantum dot display panel to a quantum dot display panel using the light sources according to an embodiment.

DETAILED DESCRIPTION

Certain embodiments will be described with reference to the accompanying drawings. However, the disclosure is not limited to the embodiments below and may be implemented in various forms and variously changed. The description regarding the embodiments is provided to complete the disclosure and let those skilled in the art completely know the scope of the disclosure. Elements in the accompanying drawings are shown enlarged from their actual sizes for convenience of description and a proportion of each element may be magnified or reduced.

It should be understood that, when it is described that a certain element is "on" or "in contact with" another element, the certain element may be directly on or connected to another element, but still another element may be present between those. In contrast, it should be understood that, when it is described that a certain element is "directly on" or "directly in contact with" another element, still another element may not be present. The same interpretation may apply to expressions describing the relationship between elements, for example, "between" or "directly between".

The expressions "first," "second" and the like may be used for describing various elements, but the elements may not be limited by the expressions. The expressions may be used only to distinguish one element from another. For example, a first element may be referred to as a second element and the second element may also be similarly referred to as the first element, while not departing from the scope of a right of the disclosure.

Unless otherwise defined specifically, a singular expression may encompass a plural expression. It is to be understood that the terms such as "comprise" or "consist of" are to designate a presence of characteristic, number, step, operation, element, part, or a combination thereof, and may be interpreted as that one or more of other characteristics, numbers, steps, operations, elements, parts or a combination thereof may be added.

The terms used in the embodiments of the disclosure may be interpreted as meanings known to those skilled in the art, unless otherwise defined.

Figure 1A:
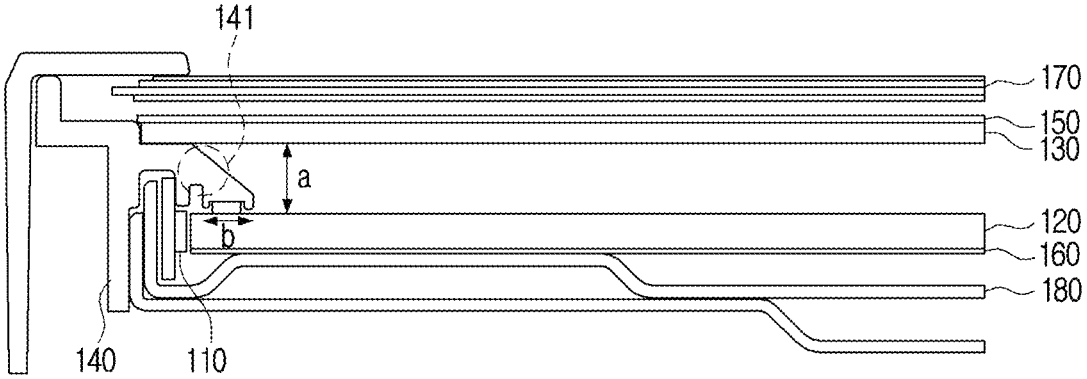
FIG. 1A is a cross-sectional view of a display panel according to an embodiment.

FIG. 1A is a cross-sectional view of a display panel according to an embodiment of the disclosure.

A display panel 100 may include a light source 110, a light guide plate 120, a diffuser plate 130, and a frame 140.

The display panel 100 may display various images according to an input image signal and include a liquid crystal display (LCD).

The light source 110 may emit light for realizing an image on the display panel 100. Particularly, in a case of an edge-lit type display panel, the light source 110 may be disposed on a side of the light guide plate 120 and indirectly emit light to the display panel 100. Alternatively, in a case of a direct-lit type display, the light source 110 may directly emit light to the display panel 100.

FIG. 1A shows the edge-lit type display panel 100 in which the light source 110 is disposed on a side of the light guide plate 120, but there is no limitation thereto, and the embodiment may be implemented in a form of a direct-lit type display device in which the light source 110 is disposed on a rear side of the display panel 100.

The light source 110 according to an embodiment of the disclosure may include a first light source and a second light source having a color different from that of the first light source. That is, the first light source and the second light source may emit light having colors different from each other. In an example, the first light source may be a light source emitting a blue light source, and the second light source may be a light source emitting a yellow light source.

Particularly, intensities of the first light source and the second light source having colors different from each other may be adjusted, thereby adjusting a color temperature of the display panel 100.

The light guide plate 120 may guide light emitted from the light source 110 to the diffuser plate 130, convert a point light source emitted from the light source 110 into a surface light source having a uniform amount of light, and output the light to the display panel 100.

The light guide plate 120 may refract, reflect, and scatter the light incident from the light source 110 in the light guide plate 120, and output uniform light through an upper surface (or light-exiting surface) facing the display panel 100. The light guide plate 120 may be formed of poly methyl methacrylate (PMMA), polycarbonate (PC), or the like. The light guide plate 120 may be included in the edge-lit type display panel 100, but may not be included in the direct-lit type display device.

The diffuser plate 130 may diffuse or scatter the light output from the upper surface of the light guide plate 120, and set the entire color and brightness of a screen displayed through the display panel 100 to be shown uniformly by diffusing the light output from the light guide plate 120.

The diffuser plate 130 according to an embodiment of the disclosure may be positioned on an upper portion of the light guide plate 120, and the light guide plate 120 and the diffuser plate 130 may be disposed to be spaced apart due to a protrusion 141 of the frame 140 by a certain distance a.

The surface light source of the light guide plate 120 may be diffused to the diffuser plate 130 through the certain optical distance a, thereby effectively preventing a hot spot phenomenon which will be described later. The distance a between the light guide plate 120 and the diffuser plate 130 according to an embodiment of the disclosure may be 0.5 mm or longer.

The frame 140 may serve as a support for fixing the light guide plate 120 and the diffuser plate 130 and include a protrusion 141 protruded between the light guide plate 120 and the diffuser plate 130.

The protrusion 141 of the frame 140 may be disposed to come into contact with a portion of the upper surface of the light guide plate 120 adjacent to the light source by a certain distance b or longer (e.g., 1.0 mm or longer), and when the protrusion is disposed to come into contact therewith by a certain distance b or longer, a light leakage phenomenon and a hot spot phenomenon which will be described later may be prevented.

In addition, the light guide plate 120 may be disposed to be spaced apart from the diffuser plate 130 due to the protrusion 141 of the frame 140 by the certain distance a (e.g., 0.5 mm or longer).

The protrusion 141 may include an inclined surface that is inclined from the light guide plate 120 towards the diffuser plate 130 at a predetermined angle. In a case of having such an inclined surface, a small bezel may be mechanically produced. In addition, when the protrusion 141 is formed with an inclined surface at a predetermined angle, the amount of light emitted to a corner of the diffuser plate 130 disposed to be spaced part from the light guide plate 120 by the certain distance a may increase, thereby reinforcing insufficient light on the corner of the display panel 100.

The predetermined angle according to an embodiment of the disclosure may be 30 degrees to 60 degrees.

In addition, the display panel 100 may further include a prism film 150, a reflector sheet 160, an open cell panel 170, and an LED heatsink 180.

The prism film 150 may include a prism sheet (not shown) and a double brightness enhance film (DBEF) (not shown), and the prism film 150 may be disposed on an upper portion of the diffuser plate 130 and a lower portion of the open cell panel 170.

The prism sheet of the prism film 150 may increase brightness by refracting or collecting light diffused through the diffuser plate 130.

The double brightness enhance film (DBEF) of the prism film 150 is an optical material for enhancing brightness of a backlight unit used in the display panel and may be referred to as a polarized light reflection film. A light collecting power may be improved as light passes through the double brightness enhance film (DBEF), and accordingly, the brightness of the display panel 100 may increase.

The reflector sheet 160 is a component capable of reflecting light, and may be disposed on a lower portion of the light guide plate 120 and an upper portion of the LED heatsink 180, and reflect light travelling from the inside of the light guide plate 120 towards the lower portion of the light guide plate 120, to the inside of the light guide plate 120. The reflector sheet 160 may be formed of a polymer as a material capable of reflecting light.

The open cell panel 170 may be a liquid crystal display (LCD) and may be disposed on an upper portion of the prism film 150.

The LED heatsink 180 may remove heat due to the light source emitted by the light source 110 and may be disposed on a lower portion of the reflector sheet 160.

Figure 1B:
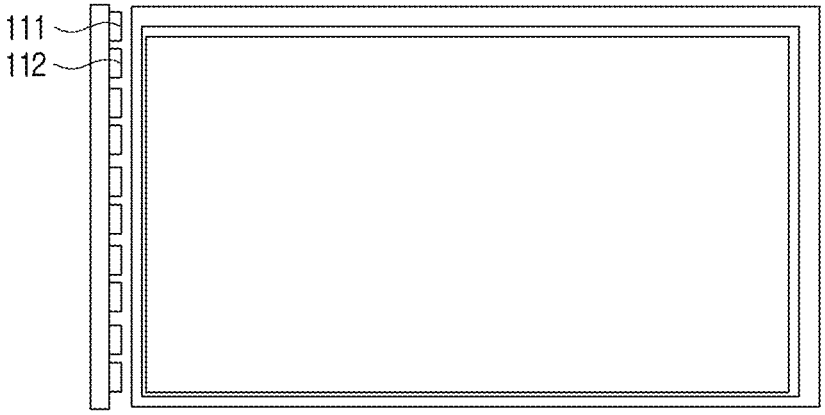
FIG. 1B is a cross-sectional view in which first light sources and second light sources of the display panel are alternately disposed on a side of a light guide plate according to an embodiment.

FIG. 1B is a cross-sectional view in which light sources are alternately disposed on a side of the light guide plate according to an embodiment of the disclosure.

FIG. 1B shows an edge-lit type display panel in which light sources are disposed on a side of a light guide plate, the light sources of the display panel 100 may consist of a first light source 111 and a second light source 112, and the first light source 111 and the second light source 112 may be alternately disposed on a side of the light guide plate.

According to an embodiment of the disclosure, the first light source 111 of the display panel 100 may be a light source coated with a bluish phosphor on a white light emitting diode (LED), and the second light source 112 thereof may be a light source coated with a yellowish phosphor on a white LED.

The first light source 111, to which the bluish phosphor is applied, may emit a blue light source, and light emitted by the first light source 111 may have a wavelength relatively lower than that of light emitted by the second light source. The second light source 112, to which the yellowish phosphor is applied, may emit a yellow light source, and light emitted by the second light source 112 may have a wavelength relatively higher than that of light emitted by the first light source. Accordingly, a color temperature of the display panel 100 may be adjusted by adjusting intensities of the first light source 111 and the second light source 112 which emit light having wavelengths different from each other.

In a case where the intensity of the first light source 111 is set to be higher than that of the second light source 112, light having a wavelength relatively lower than a wavelength of light emitted by a light source using a typical white LED may be emitted to the display panel 100, and in this case, a color temperature of the display panel 100 may be adjusted to a bluish color temperature mode.

In a case where the intensity of the second light source 112 is set to be higher than that of the first light source 111, light having a wavelength relatively higher than a wavelength of light emitted by a light source using a typical white LED may be emitted to the display panel 100, and in this case, a color temperature of the display panel 100 may be adjusted to a yellowish color temperature mode.

As a method for adjusting the intensities of the first light source 111 and the second light source 112, a method for directly adjusting intensities of currents of the first light source 111 and the second light source 112 or a pulse width modulation (PWM) method may be used.

In the method for directly adjusting intensities of currents of the first light source 111 and the second light source 112, a color temperature of the display panel 100 may be adjusted by adjusting a current ratio of the first light source 111 to the second light source 112.

According to an embodiment of the disclosure, a normal mode (e.g., 10000 K) of the color temperature of the display panel 100 may be a mode in which a current ratio of the first light source 111 to the second light source 112 is 5:5. In this case, a bluish color temperature mode (e.g., 14000 K) of the display panel 100 may be a mode in which the current ratio of the first light source 111 to the second light source 112 is 7:3, and a yellowish color temperature mode (e.g., 14000 K) may be a mode in which the current ratio of the first light source 111 to the second light source 112 is 3:7. However, there is no limitation to such current ratios, and a user may directly adjust the current ratio to adjust a color temperature of the display panel 100.

In the pulse width modulation (PWM) method, a color temperature of the display panel 100 may be adjusted by adjusting PWM duty ratios of the first light source and the second light source.

The PWM method is a method for adjusting brightness of the light source by adjusting ratios of on-off time of the light source while maintaining a current, not directly adjusting the currents of the first light source 111 and the second light source 112. When a PWM emission signal is in a Hi state, the light source may be turned on (on time), and when the PWM emission signal is in a low state, the light source may be turned off (off time).

The PWM duty ratio indicates a ratio of an on-time duty occupying in one cycle of the PWM emission signal, and when a ratio of the on time duty to the off time duty in one cycle of the PWM emission signal is 4:1, the PWM duty ratio may be 80%.

According to an embodiment of the disclosure, in the normal mode of the color temperature of the display panel 100, the PWM duty ratio of the first light source is 50% and the PWM duty ratio of the second light source may be 50%. In this case, the bluish color temperature mode of the display panel 100 may be a mode in which the PWM duty ratio of the first light source is 70% and the PWM duty ratio of the second light source is 50%, and the yellowish color temperature mode may be a mode in which the PWM duty ratio of the first light source is 70% and the PWM duty ratio of the second light source is 30%. However, there is no limitation to the PWM duty ratios described above, and a user may directly adjust the PWM duty ratios to adjust a color temperature of the display panel 100.

The display panel and the display device according to the disclosure may adjust a color temperature of the display panel by using a plurality of light sources having different colors, without using only one light source as before.

As another effect according to the disclosure, a hot spot phenomenon may be prevented by disposing the diffuser plate in the display panel and disposing the light guide plate and the diffuser plate to be spaced apart by a certain distance or longer.

Figure 2:
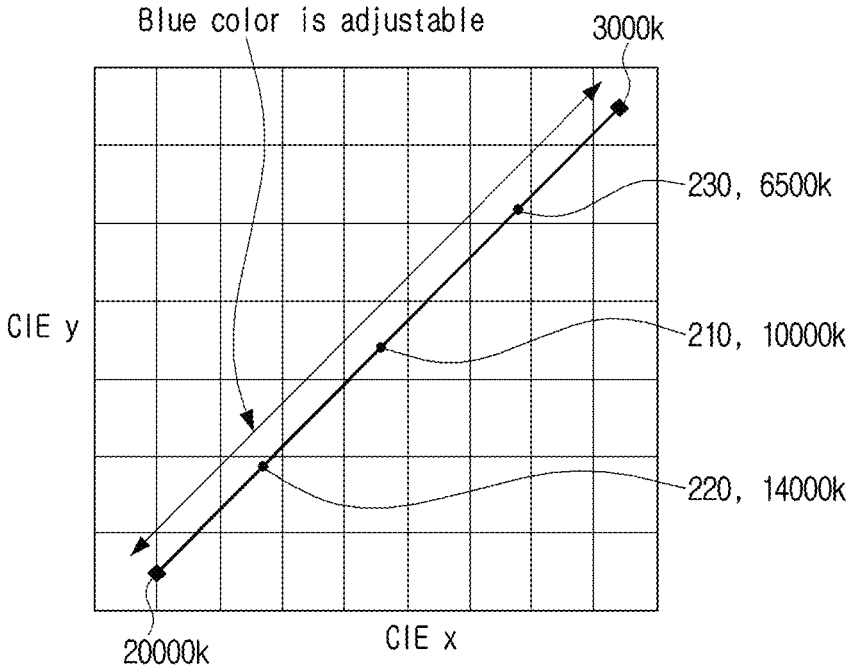
FIG. 2 is a graph showing a color temperature adjustable range using the first light source and the second light source according to an embodiment.

FIG. 2 is a graph showing a color temperature adjustable range using the first light source and the second light source according to an embodiment of the disclosure.

FIG. 2 is a graph of CIE1931 color coordinates, and a color temperature variable range of the display panel 100, in a case of using the first light source and the second light source according to an embodiment of the disclosure, is marked on the CIE1931 color coordinates.

In a case of adjusting the intensities of the first light source and the second light source of the display panel 100 according to an embodiment of the disclosure, the color temperature variable range of the display panel 100 may be 3000 K to 20000 K.

The color temperature of the display panel 100 may be adjusted by adjusting the intensities of the first light source and the second light source, by adjusting the currents of the first light source and the second light source or using the PWM method described above.

Specifically, in a case where the color temperature mode is a normal mode 210 (10000 K), the current ratio of the first light source to the second light source may be set as 1:1 or the PWM duty ratio may be set as 50%. In in a case where the color temperature mode is a mode 220 (14000 K) in which light is expressed in a bluish color, the current ratio of the first light source to the second light source may be set as 7:3, or the PWM duty ratio of the first light source may be set as 70% and the PWM duty ratio of the second light source may be set as 30%. In addition, in a case of a yellowish color temperature mode 230 (6500 K), the current ratio of the first light source to the second light source may be set as 3:7, or the PWM duty ratio of the first light source may be set as 30% and the PWM duty ratio of the second light source may be set as 70%.

Accordingly, the display panel 100 according to the disclosure may adjust the color temperature of the display panel 100 without decreasing a gray level of each primary color, by adjusting the color temperature of the display panel 100 by adjusting the intensities of the first light source and the second light source.

Figure 3:
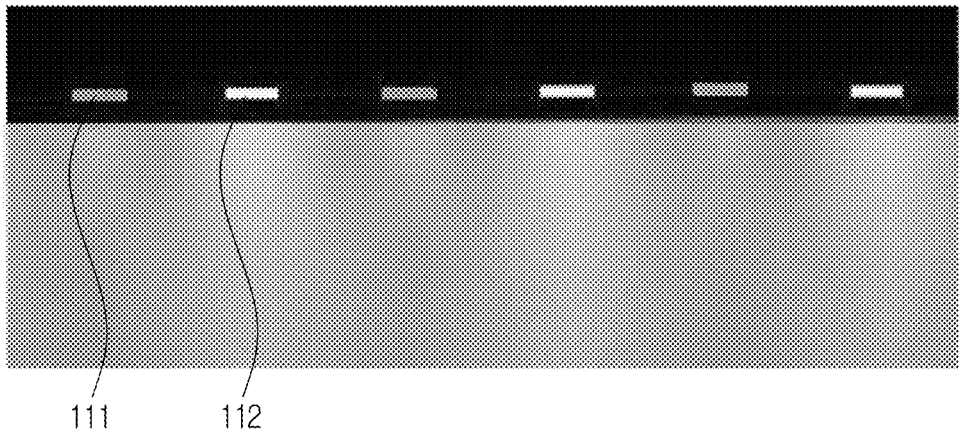
FIG. 3 is a view for a hot spot phenomenon appearing due to the usage of the first light source and the second light source.

FIG. 3 is a view of a hot spot phenomenon appearing according to a use of the first light source and the second light source.

In a case of using the first light source 111 and the second light source 112 according to an embodiment of the disclosure, a regular hot spot phenomenon may occur in the vicinity of a panel adjacent to the first light source 111 and the second light source 112.

The hot spot phenomenon is a problem occurring, when using a plurality of light sources 111 and 112 having colors (wavelengths) different from each other, due to non-uniform emission of light from each of the light sources to the light guide plate, and means a phenomenon in that a color corresponding to each light source appears to be dark on a panel in the vicinity of the light source.

FIG. 3 may be a view showing the hot spot phenomenon, in a case of using the first light source 111 coated with the bluish phosphor on a white LED and the second light source 112 coated with the yellowish phosphor on the white LED in the display panel 100.

In addition, FIG. 3 may be a view showing the hot spot phenomenon in a case of using the first light source 111, to which a small amount of the phosphor or no phosphor is applied to a blue LED, and the second light source 112, to which a large amount of the phosphor is applied to a blue LED in a display panel 400 including a quantum dot film (hereinafter, a quantum dot display panel). The phosphor in the quantum dot display panel 400 may be a first phosphor including red and green phosphors or a second phosphor including a yellowish phosphor.

In a case of the display panel 100 or the quantum dot display panel 400 using the first light source 111 or the second light source 112, the hot spot phenomenon may occur in blue in the vicinity of the first light source 111 or in red or yellow in the vicinity of the second light source 112.

In order to solve such a problem, the light guide plate and the diffuser plate may be disposed to be spaced apart due to the protrusion of the frame by a first distance or longer, and a portion of the upper surface of the light guide plate adjacent to the light source may be brought into contact with the protrusion of the frame by a second distance or longer.

When the light guide plate and the diffuser plate are disposed to be spaced apart by the first distance or longer, the regular hot spot phenomenon due to application of the first light source 111 and the second light source 112 may be prevented by the properties of the diffuser plate having excellent diffusion properties of light.

In addition, the hot spot phenomenon is significantly observed in the vicinity of the light guide plate adjacent to the light source, and accordingly, when the portion of the upper surface of the light guide plate adjacent to the light source is brought into contact with the protrusion of the frame by the second distance or longer, the portion in the vicinity of the light guide plate adjacent to the light source may be covered with the protrusion. In this case, the light source generated in the vicinity of the light guide plate adjacent to the light source may be prevented from being emitted to the diffuser plate, thereby preventing the hot spot phenomenon.

According to an embodiment of the disclosure, the first distance may be 0.5 mm and the second distance may be 1.0 mm. That is, in a case where the light guide plate and the diffuser plate are disposed to be spaced apart by 0.5 mm or longer and the portion of the upper surface of the light guide plate adjacent to the light source is brought into contact with the protrusion of the frame by 1.0 mm or longer, the regular hot spot phenomenon of the display panel 100 or the quantum dot display panel 400 using the first light source 111 and the second light source 112.

Figure 4A:
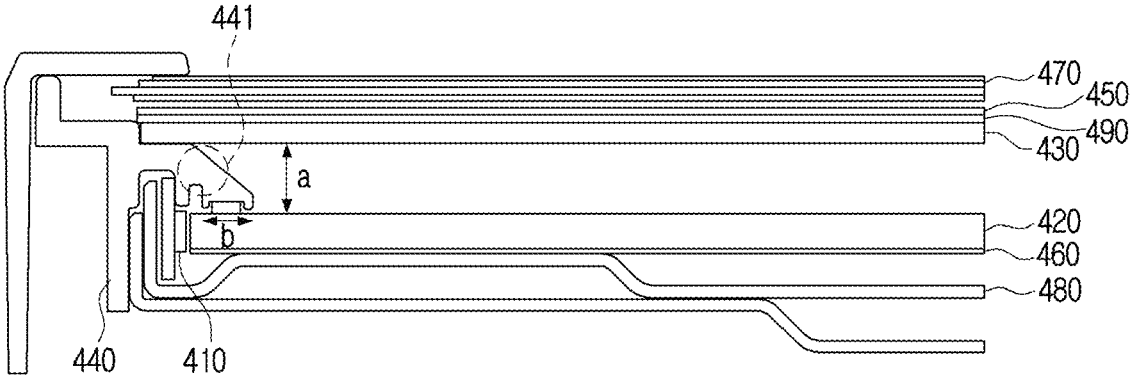
FIG. 4A is a cross-sectional view of a display panel including a quantum dot film according to an embodiment.

FIG. 4A is a cross-sectional view of a quantum dot display panel including a quantum dot film according to an embodiment of the disclosure.

In a typical quantum dot display panel, a white LED which is a light source of a related art display panel is replaced with a blue LED, and a quantum dot film which absorbs blue light emitted by the blue LED and converts the blue light into red and green light is further included. A principle of the quantum dot film will be described later with reference to FIG. 4B.

The quantum dot display panel 400 according to an embodiment of the disclosure includes a light source 410, a light guide plate 420, a diffuser plate 430, a frame 440, and a quantum dot film 490.

In addition, the quantum dot display panel 400 may further include a prism film 450, a reflector sheet 460, an open cell panel 470, and a LED heatsink 480.

The light source 410 may emit light for realizing an image on the display panel 400 and the quantum dot display panel 400 may be configured as the edge-lit type or the direct-lit type quantum dot display panel 400 depending on the position of the light source 410 as described above. In addition, as will be described in FIG. 4C, the light source 410 may consist of a first light source 411 and a second light source 412 having a color (wavelength) different from that of the first light source.

The light source of a typical quantum dot display panel uses only a blue LED, but the quantum dot display panel 400 according to an embodiment of the disclosure may use the first light source 411, to which a small amount of the phosphor or no phosphor is applied to a blue LED, and the second light source 412, to which a large amount of the phosphor is applied to a blue LED.

The positions and the functions of the light guide plate 420, the diffuser plate 430, the prism film 450, the reflector sheet 460, the open cell panel 470, and the LED heatsink 480 are the same as those of the display panel 100 of FIG. 1A, and therefore the description thereof will be omitted.

The diffuser plate 430 may diffuse or scatter the light emitted from the upper surface of the light guide plate 420, and set the entire color and brightness of a screen displayed through the quantum dot display panel 400 to be shown uniformly by diffusing the light emitted from the light guide plate 120.

The diffuser plate 430 according to an embodiment of the disclosure may be positioned on an upper portion of the light guide plate 420, and the light guide plate 420 and the diffuser plate 430 may be disposed to be spaced apart due to a protrusion 441 of the frame 440 by a certain distance a.

According to an embodiment of the disclosure, the diffuser plate 430 may be disposed to be spaced apart from the light guide plate 420 by a certain optical distance a. The surface light source of the light guide plate 420 may be diffused to the diffuser plate 430 through the certain optical distance a, thereby effectively preventing a hot spot phenomenon which will be described later. The distance a between the light guide plate 420 and the diffuser plate 430 according to an embodiment of the disclosure may be 0.5 mm or longer.

The frame 440 may serve as a support for fixing the light guide plate 420 and the diffuser plate 430 and include the protrusion 441 protruded between the light guide plate 420 and the diffuser plate 430.

The protrusion 441 of the frame 440 may be disposed to come into contact with a portion of the upper surface of the light guide plate 420 adjacent to the light source by a certain distance b or longer (e.g., 1.0 mm or longer), and in this case, a light leakage phenomenon and the hot spot phenomenon described above of the quantum dot display panel 400 may be prevented.

The protrusion 441 may include an inclined surface that is inclined from the light guide plate 420 towards the diffuser plate 430 at a predetermined angle. In a case of having such an inclined surface, a small bezel may be mechanically produced. In addition, when the protrusion 441 is formed with an inclined surface, the amount of light emitted to a corner of the diffuser plate 430 spaced part from the light guide plate 420 by the optical distance may increase, thereby reinforcing insufficient light on the corner of the quantum dot display panel 400.

The predetermined angle according to an embodiment of the disclosure may be 30 degrees to 60 degrees.

In the quantum dot display panel 400, the light guide plate 420 and the diffuser plate 430 may be disposed to be spaced apart due to the protrusion 441 of the frame 440 by the first distance a or longer, in the same manner as in the display panel 100 shown in FIG. 1A.

The quantum dot film 490 is disposed on an upper portion of the diffuser plate 430, and in a case where the quantum dot display panel 400 further includes the prism film 450, the quantum dot film 490 may be disposed on a lower portion of the prism film 450. The quantum dot film 490 will be described in detail with reference to FIG. 4B.

Figure 4B:
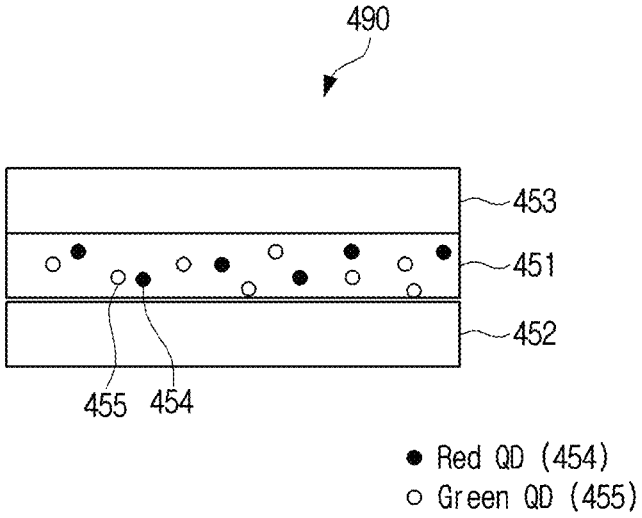
FIG. 4B is a cross-sectional view of the quantum dot film according to an embodiment.

FIG. 4B is a cross-sectional view of the quantum dot film according to an embodiment of the disclosure.

The quantum dot film 490 includes red quantum dots 454 and green quantum dots 455, and the blue light emitted from the blue LED realizes white light having excellent optical properties in a process of passing through the quantum dot film 490 in which the red quantum dots 454 and the green quantum dots 455 are mixed.

The quantum dots are nano-sized semiconductor particles, and a quantum confinement effect may be exhibited due to a very small size thereof. The quantum confinement effect is a phenomenon in that, when a size of a substance is decreased to a nano size or smaller, a band gap of the substance increases. Accordingly, in a case where light having a wavelength having energy greater than the band gap of the quantum dots is incident to the quantum dots, the quantum dots absorb the light and are excited, and the quantum dots drop back, when the light having a specific wavelength is emitted. The wavelength of the emitted light has a value corresponding to the band gap and light emitting properties due to the quantum confinement effect vary depending on a size, a composition, and the like of the quantum dots, and therefore, the quantum dots are variously used in various light emitting elements and electronic devices by adjusting those.

A quantum dot display panel having excellent color reproducibility may be produced by using the quantum dot. The quantum dot is used as a phosphor in a display device, and a quantum dot film produced by dispersing quantum dots to a transparent curing resin is used in order to optically combine the light source and the quantum dot.

FIG. 4B is a cross-sectional view of the quantum dot film 490 and the quantum dot film 490 may be configured to have a multilayer structure.

The quantum dot film 490 consists of a resin film 451 containing quantum dots, and barrier films 452 and 453 formed on an upper portion and a lower portion of the resin film.

In the resin film 451, a plurality of the ref and green quantum dots 454 and 455 are dispersed in the transparent curing resin, and the resin film 451 converts light incident to the quantum dots into light having a desired wavelength. For example, in a case where the light incident to the resin film 451 is blue light, the resin film 451 may include the green quantum dots 455 which may absorb blue light and convert the blue light into green light, and the red quantum dots 454 which may absorb blue light and convert the blue light into red light.

Accordingly, when the light source of the quantum dot display panel 400 emits blue light, the blue light may be transmitted through a quantum dot region and scattered as light having various wavelength ranges including red, green, and blue light. Therefore, the color reproducibility realized on the quantum dot display panel 400 may be improved.

Figure 4C:
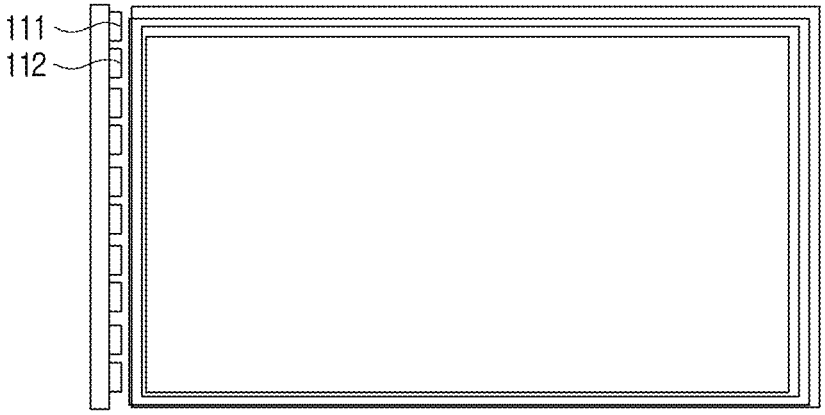
FIG. 4C is a cross-sectional view in which first light sources and second light sources of the quantum dot display are alternately disposed on a side of the light guide plate according to an embodiment.

FIG. 4C shows only the green quantum dots 455 and the red quantum dots 454 in the resin film 451, but there is no limitation thereto, and quantum dots capable of scattering light having various wavelength ranges may be included as needed.

The transparent curing resin in the resin film 451 protects the red and green quantum dots 454 and 455 from external shock or environment and disperses and fixes the quantum dots.

The barrier films 452 and 453 may block a supply of moisture or oxygen into the resin film 451. The quantum dots are vulnerable to moisture and oxygen, and accordingly, when moisture and oxygen is supplied from the outside, there may be a limit to perform the application. Therefore, the barrier films 452 and 453 having resistance to oxygen and moisture may be disposed on the upper portion and the lower portion of the resin film 451 to block a supply of oxygen and moisture to the resin film 451.

The quantum dot film 490 may be disposed on the upper portion of the diffuser plate, and the light source emitted by the diffuser plate may be transmitted through the quantum dot film 490 and scattered as light having various wavelength ranges.

FIG. 4C is a cross-sectional view in which the first light sources 111 and the second light sources 112 of the quantum dot display panel are alternately disposed on a side of the light guide plate according to an embodiment of the disclosure.

FIG. 4C shows an edge-lit type in which the first light sources 411 and the second light sources 412 are disposed on a side of the light guide plate, and the first light sources 411 and the second light sources 412 are alternately disposed on a side of the light guide plate.

In a case of the quantum dot display panel 400 according to an embodiment of the disclosure, the first light source 411 is a light source, to which a small amount of the phosphor or no phosphor is applied to a blue LED, the second light source 412 is a light source, to which a large amount of the phosphor is applied to a blue LED, and the phosphor may be a first phosphor including a red phosphor and a green phosphor or a second phosphor including a yellowish phosphor.

The quantum dot display panel 400 according to an embodiment of the disclosure may adjust the color temperature of the quantum dot display panel 400 by adjusting the intensities of the first light source 411 and the second light source 412.

Light emitted by the first light source 411, to which a small amount of the phosphor or no phosphor is applied, may have a wavelength relatively lower than that of light emitted by the second light source, and light emitted by the second light source 412, to which a large amount of the first phosphor or the second phosphor is applied, may have a wavelength relatively higher than that of light emitted by the first light source.

Accordingly, when the intensity of the first light source 411 is set to be higher than that of the second light source 412, the surface light source having a relatively low wavelength may be emitted to the quantum dot display panel 400, and accordingly, a color temperature mode of the quantum dot display panel 400 may be set as a bluish color temperature mode.

In addition, when the intensity of the second light source 412 is set to be higher than that of the first light source 411, the surface light source having a relatively high wavelength may be emitted to the quantum dot display panel 400, and accordingly, the color temperature mode of the quantum dot display panel 400 may be set as a yellowish color temperature mode.

As a method for adjusting the intensities of the first light source 411 and the second light source 412 of the quantum dot display panel 400, a method for directly adjusting intensities of currents of the first light source 411 and the second light source 412 or a pulse width modulation (PWM) method may be used, and the description thereof has been made above and therefore will be omitted.

Figure 5:
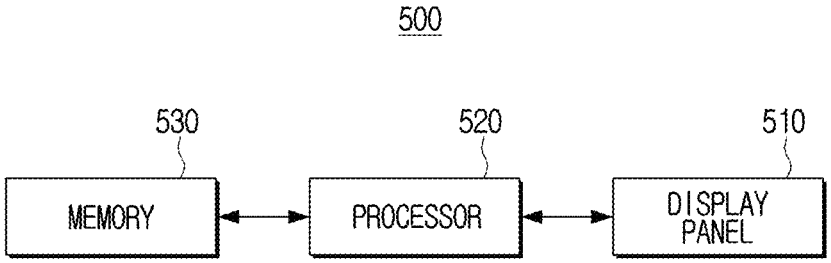
FIG. 5 is a block diagram showing a configuration of a display device according to an embodiment.

FIG. 5 is a block diagram showing a configuration of a display device according to an embodiment of the disclosure.

A display device 500 may include a display panel 510, a processor 520, and a memory 530.

The display panel 510 may display various images according to an input image signal and include a liquid crystal display (LCD).

The display panel 510 may include a first light source, a second light source having a color different from that of the first light source, a light guide plate converting a point light source generated by the first light source and the second light source into a surface light source, a diffuser plate positioned on an upper portion of the light guide plate and diffusing the surface light source emitted by the light guide plate, and a frame supporting the light guide plate and the diffuser plate and including a protrusion protruded between the diffuser plate and the light guide plate.

The display panel 510 of the display device 500 may be the display panel of FIG. 1A or the quantum dot display panel of FIG. 4A according to an embodiment of the disclosure. In a case where the display panel of the display device 500 is a quantum dot display panel, the display panel may further include a quantum dot film, and a quantum dot film may be disposed on an upper portion of a diffuser plate and a lower portion of a prism film.

In a case where the display panel 510 of the display device 500 is the display panel of FIG. 1A, the light source may include a first light source coated with a bluish phosphor on a white LED and a second light source coated with a yellowish phosphor on a white LED.

In a case where the display panel 510 of the display device 500 is the quantum dot display panel of FIG. 4A, the light source may be a first light source, to which a small amount of the phosphor or no phosphor is applied to a blue LED, and a second light source, to which a large amount of the phosphor is applied to a blue LED, and the phosphor may be a first phosphor including a red phosphor and a green phosphor or a second phosphor including a yellowish phosphor.

The processor 520 may include or be defined as one or more of a central processing unit (CPU), a microcontroller unit (MCU), a microprocessing unit (MPU), a controller, an application processor (AP), a communication processor (CP), and an ARM processor processing digital signals. In addition, the processor 520 may be implemented as a system on chip (SoC) or a large scale integration (LSI) with embedded processing algorithms or may be implemented in a form of a field programmable gate array (FPGA). The processor 520 may execute various functions by executing computer executable instructions stored in a memory which will be described later. Particularly, the processor 520 may be electrically connected to the memory and control general operations and functions of the display device 500.

The processor 520 may adjust the color temperature of the display panel 510 by controlling currents of the first light source and the second light source of the display panel 510.

In a case where a user makes an input regarding the color temperature mode for changing the color temperature of the display panel 510 or the display device 500 automatically makes an input regarding the color temperature mode, the processor 520 may control the currents of the first light source and the second light source to correspond to the input color temperature mode.

Specifically, the processor 520 may change the color temperature mode by the method for adjusting the intensities of the currents of the first light source and the second light source or the PWM method to correspond to the input color temperature mode. Therefore, the color temperature of the display device 500 may be adjusted without decreasing the gray level of each color.

The memory 530 may store an instruction or data relating to at least one of other elements of the display device 500. Particularly, the memory 530 may be implemented as an internal memory such as a ROM (for example, electrically erasable programmable read-only memory (EEPROM)) or a RAM included in the processor 520, or may be implemented as a memory separated from the processor 520. In this case, the memory 530 may be implemented in a form of a memory embedded in the display device 500 or implemented in a form of a memory detachable from the display device 500 according to data storage purposes. For example, data for driving the display device 500 may be stored in a memory embedded in the display device 500, and data for extension functions of the display device 500 may be stored in a memory detachable from the display device 500. The memory embedded in the display device 500 may be implemented as at least one of a volatile memory (e.g., a dynamic RAM (DRAM), a static RAM (SRAM), or a synchronous dynamic RAM (SDRAM)) and a non-volatile memory (e.g., a one time programmable ROM (OTPROM), a programmable ROM (PROM), an erasable and programmable ROM (EPROM), an electrically erasable and programmable ROM (EEPROM), a mask ROM, a flash ROM, a flash memory (e.g., a NAND flash or a NOR flash), a hard drive, and a solid state drive (SSD)), and the memory detachable from the display device 500 may be implemented in a form of a memory card (for example, a compact flash (CF), an secure digital (SD), a micro secure digital (micro-SD), a mini secure digital (mini-SD), an extreme digital (xD), or a multi-media card (MMC)), an external memory which may be connected to a USB port (for example, a USB memory), and the like.

Particularly, the memory 530 may store information corresponding to a plurality of color temperature modes. In a case of using the method for adjusting the intensities of the currents of the first light source and the second light source, the information corresponding to a plurality of color temperature modes may be information regarding a current ratio of the first light source to the second light source, and in a case of using the PWM method, the information may be information regarding PWM duty ratios of the first light source and the second light source.

In a case of using the method for adjusting the intensities of the currents, the information regarding the current ratio of the first light source to the second light source corresponding to the plurality of color temperature modes may be stored in the memory 530. For example, information indicating that the current ratio of the first light source to the second light source is 5:5 may be stored in the memory 530 as information regarding the normal mode (e.g., 10000 K) among the color temperature modes, and information indicating that the current ratio of the first light source to the second light source is 7:3 may be stored in the memory 530 as information regarding the bluish color temperature mode (e.g., 14000 K). In addition, information indicating that the current ratio of the first light source to the second light source is 3:7 may be stored in the memory 530 as information regarding the yellowish color temperature mode (e.g., 6500 K).

In a case of using the PWM method, information regarding the PWM duty ratios of the first light source and the second light source corresponding to the plurality of color temperature modes may be stored in the memory 530. For example, information indicating that the PWM duty ratio of the first light source is 50% and the PWM duty ratio of the second light source is 50% may be stored in the memory 530 as the information regarding the normal mode (e.g., 10000 K) among the color temperature modes, information indicating that the PWM duty ratio of the first light source is 70% and the PWM duty ratio of the second light source is 30% may be stored in the memory 530 as the information regarding the bluish color temperature mode (e.g., 14000 K). In addition, information indicating that the PWM duty ratio of the first light source is 30% and the PWM duty ratio of the second light source is 70% may be stored in the memory 530 as the information regarding the yellowish color temperature mode (e.g., 6500 K). The above example has been described using a case where the number of color temperature modes are three, but there is no limitation thereto, and a plurality of color temperature modes in a range of 3000 K to 20000 K may be used. In addition, a user may freely set the color temperature modes, and information corresponding to a plurality of color temperature modes in a range of 3000 K to 20000 K may be stored in the memory 530.

Based on the information corresponding to the plurality of color temperature modes stored in the memory 530, the processor 520 may adjust the color temperature of the display device 500 without decreasing the gray level of each color, by adjusting the color temperature of the display device 500 by adjusting the intensities of the first color source and the second color source.

Figure 6:
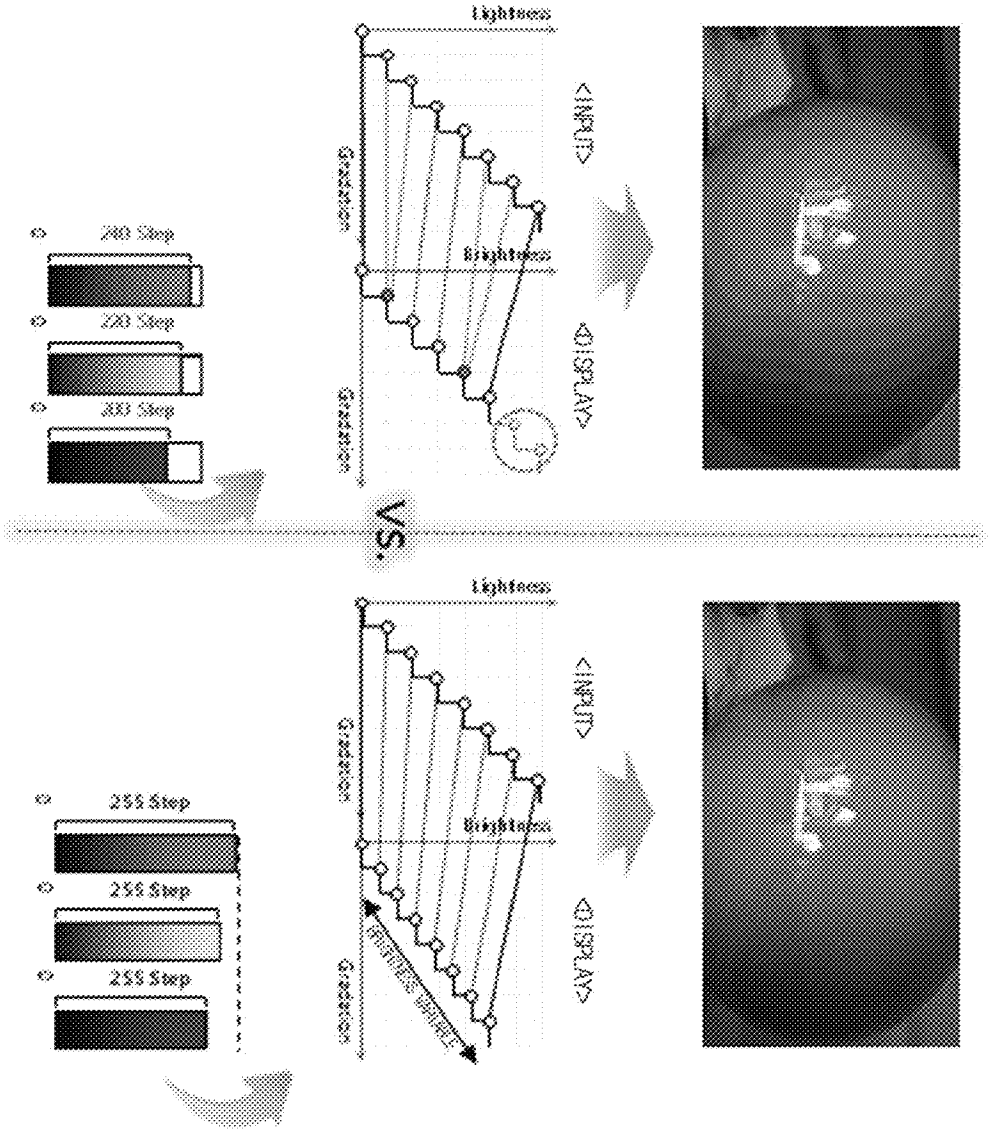
FIG. 6 is a view for comparing gradation expression of a display panel using the light source according to an embodiment to gradation expression of a typical display panel.

FIG. 6 is a view for comparing gradation expression of the display panel using the light source according to an embodiment of the disclosure to gradation expression of a typical display panel.

In a case of a typical display panel, a color temperature was adjusted by decreasing a gray level of a red, green, or a blue color in accordance with a screen mode for adjusting a color temperature. Accordingly, in a case where the gray level of the red, green, or blue color is decreased as shown in right side of FIG. 6, the number of gradations is decreased and color accuracy decreases. Specifically, the color expression level is decreased, thereby decreasing the number of gradations, and accordingly, gradation expression deteriorates due to a fixed brightness step for each color displayable by the display.

In contrast, in a case of adjusting the color temperature of the display panel using the light source according to an embodiment of the disclosure, the gray level of the red, green, and blue color is not decreased, thereby maintaining the number of gradations. Accordingly, higher brightness and a higher contrast ratio may be maintained. Therefore, in a case of a display panel using a light source including a first light source and a second light source, detailed gradation expression of colors may be maintained by changing brightness for each color displayable by a display screen through the first light source and the second light source.

FIG. 7 is a view for comparing a related art quantum dot display panel to the quantum dot display panel using the light sources according to an embodiment of the disclosure.

In a case where the color temperature is in the normal mode of 10000 K, the gray level of the red, green, and blue color is not decreased, and accordingly, the related art quantum dot display panel may also maintain the same performance as in the quantum dot display panel using the light source according to an embodiment of the disclosure.

However, in a case where the color temperature is adjusted to a mode of 6500 K or the color temperature is adjusted to a mode of 14000 K, the gray level of the red, green, and blue color was decreased in the related art quantum dot display panel. A decrease in gray level causes a decrease in brightness and contrast ratio, and gradation expression is also limited, thereby deteriorating the gradation expression.

In contrast, the quantum dot display panel using the light source including the first light source and the second light source according to an embodiment of the disclosure may adjust the color temperature by directly controlling the currents of the first light source and the second light source, and accordingly, the gray level of the red, green, and blue color may not be decreased, even when the color temperature is adjusted. Therefore, the color temperature may be adjusted without any loss of brightness and contrast ratio, and the loss of gradation may also be prevented, thereby maintaining detailed gradation expression.

Meanwhile, according to an embodiment of the disclosure, various embodiments described above may be implemented as software including instructions stored in machine (e.g., computer)-readable storage media. The machine is an apparatus which invokes instructions stored in the storage medium and is operated according to the invoked instructions, and may include a display device (e.g., display device A) according to the disclosed embodiments. In a case where the instruction is executed by a processor, the processor may execute a function corresponding to the instruction directly or using other elements under the control of the processor. The instruction may include a code generated by a compiler or executed by an interpreter. The machine-readable storage medium may be provided in a form of a non-transitory storage medium. Here, the term "non-transitory" merely mean that the storage medium is tangible while not including signals, and it does not distinguish that data is semi-permanently or temporarily stored in the storage medium.

In addition, according to an embodiment of the disclosure, the methods according to various embodiments described above may be provided to be included in a computer program product. The computer program product may be exchanged between a seller and a purchaser as a commercially available product. The computer program product may be distributed in the form of a machine-readable storage medium (e.g., compact disc read only memory (CD-ROM)) or distributed online through an application store (e.g., PlayStore™). In a case of the on-line distribution, at least a part of the computer program product may be at least temporarily stored or temporarily generated in a storage medium such as a memory of a server of a manufacturer, a server of an application store, or a relay server.

In addition, each of the elements (for example, a module or a program) according to various embodiments described above may be composed of a single entity or a plurality of entities, and some sub-elements of the abovementioned sub-elements may be omitted or other sub-elements may be further included in various embodiments. Alternatively or additionally, some elements (e.g., modules or programs) may be integrated into one entity to perform the same or similar functions performed by each respective element prior to integration. Operations performed by a module, a program, or other elements, in accordance with various embodiments, may be performed sequentially, in a parallel, repetitive, or heuristically manner, or at least some operations may be performed in a different order, omitted, or may add a different operation.

While embodiments of the disclosure have been particularly shown and described with reference to the drawings, the embodiments are provided for the purposes of illustration and it will be understood by one of ordinary skill in the art that various modifications and equivalent other embodiments may be made from the disclosure. Accordingly, the true technical scope of the disclosure is defined by the technical spirit of the appended claims.

What is claimed is:

1. A display panel comprising:

a first light source;

a second light source having a color different from a color of the first light source;

a light guide plate configured to convert a point light source, which is emitted by the first light source and the second light source toward a side surface of an edge portion of the light guide plate, into a surface light source, the side surface facing the first light source and the second light source;

a diffuser plate positioned facing an upper portion of the light guide plate and configured to diffuse the surface light source emitted by the light guide plate; and a frame supporting the light guide plate and the diffuser plate and comprising a protrusion protruded between the diffuser plate and the light guide plate, wherein the light guide plate and the diffuser plate are disposed to be spaced apart by the protrusion by a first distance or longer and the protrusion is in contact with the edge portion of the light guide plate by a second distance or longer in a longitudinal direction of the light guide plate, to prevent light generated in the edge portion of the light guide plate from being emitted to the diffuser plate, thereby preventing a hot spot phenomenon, and wherein the second distance is longer than the first distance.

2. The display panel according to claim 1, wherein the protrusion comprises an inclined surface that is inclined from the light guide plate towards the diffuser plate at a predetermined angle.

3. The display panel according to claim 2, wherein the first distance is 0.5 mm and the second distance is 1 mm.

4. The display panel according to claim 1, wherein the first light source and the second light source are alternately disposed.

5. The display panel according to claim 1, wherein the first light source is a light source coated with a bluish phosphor on a white light emitting diode (LED), and wherein the second light source is a light source coated with a yellowish phosphor on a white LED.

6. The display panel according to claim 1, further comprising a quantum dot film disposed on an upper portion of the diffuser plate, wherein the first light source is a blue light emitting diode (LED), and wherein the second light source is a light source coated with a phosphor on a blue LED.

7. The display panel according to claim 6, wherein the quantum dot film has a multilayer structure, and wherein the quantum dot film comprises a resin film comprising quantum dots and barrier films formed on an upper portion and a lower portion of the resin film, respectively.

8. The display panel according to claim 6, wherein the phosphor is at least one of a first phosphor comprising red and green phosphors or a second phosphor comprising a yellowish phosphor.

9. The display panel according to claim 1, wherein a color temperature of the display panel is adjusted by adjusting currents of the first light source and the second light source, respectively.

10. The display panel according to claim 1, wherein a color temperature of the display panel is adjusted by adjusting intensities of the first light source and the second light source, respectively, by a pulse width modulation (PWM) method.

11. A display device comprising:

a display panel; and a processor configured to control the display panel, wherein the display panel comprises:

a first light source;

a second light source having a color different from a color of the first light source;

a light guide plate configured to convert a point light source, which is emitted by the first light source and the second light source toward a side surface of an edge portion of the light guide plate, into a surface light source, the side surface facing the first light source and the second light source;

a diffuser plate positioned facing an upper portion of the light guide plate and configured to diffuse the surface light source emitted by the light guide plate; and a frame supporting the light guide plate and the diffuser plate and comprising a protrusion protruded between the diffuser plate and the light guide plate, wherein the light guide plate and the diffuser plate are disposed to be spaced apart by the protrusion by a first distance or longer and the protrusion is in contact with the edge portion of the light guide plate by a second distance or longer in a longitudinal direction of the light guide plate, to prevent light generated in the edge portion of the light guide plate from being emitted to the diffuser plate, thereby preventing a hot spot phenomenon, wherein the second distance is longer than the first distance, and wherein the processor is further configured to adjust a color temperature of the display panel by controlling currents of the first light source and the second light source.

12. The display device according to claim 11, wherein the protrusion comprises an inclined surface that is inclined from the light guide plate towards the diffuser plate at a predetermined angle.

13. The display device according to claim 11, further comprising:

a memory configured to store information regarding a current ratio of the first light source to the second light source corresponding to a plurality of color temperature modes, respectively, wherein, based on one color temperature mode selected among the plurality of color temperature modes, the processor is further configured to adjust the color temperature of the display panel by adjusting currents of the first light source and the second light source, respectively, based on the information, stored in the memory, corresponding to the one color temperature mode.

14. The display device according to claim 11, further comprising:

a memory configured to store information regarding pulse width modulation (PWM) duty ratios of the first light source and the second light source, respectively, in correspondence with a plurality of color temperature modes, wherein, based on one color temperature mode selected among the plurality of color temperature modes, the processor is further configured to adjust the color temperature of the display panel by adjusting intensities of the first light source and the second light source, respectively, by a pulse width modulation (PWM) method based on the information, stored in the memory, corresponding to the one color temperature mode.

15. The display device according to claim 11, wherein the first light source is a light source coated with a bluish phosphor on a white light emitting diode (LED), and wherein the second light source is a light source coated with a yellowish phosphor on a white LED.

16. The display device according to claim 11, wherein the display panel further comprises a quantum dot film disposed on an upper portion of the diffuser plate, wherein the first light source is a blue light emitting diode (LED), and wherein the second light source is a light source coated with a phosphor on a blue LED.

17. The display device according to claim 16, wherein the phosphor is at least one of a first phosphor comprising red and green phosphors or a second phosphor comprising a yellowish phosphor.

* * * * *